US007789093B2

(12) United States Patent
Tojo et al.

(10) Patent No.: US 7,789,093 B2
(45) **Date of Patent: *Sep. 7, 2010**

(54) HAIR HOLDER

(75) Inventors: Takehiko Tojo, Tochigi (JP); Hideo Kobayashi, Tochigi (JP)

(73) Assignee: Kao Corporation, Tokyo (JP)

( * ) Notice: Subject to any disclaimer, the term of this patent is extended or adjusted under 35 U.S.C. 154(b) by 200 days.

This patent is subject to a terminal disclaimer.

(21) Appl. No.: 10/560,044

(22) PCT Filed: Dec. 21, 2004

(86) PCT No.: PCT/JP2004/019081

§ 371 (c)(1),
(2), (4) Date: Dec. 8, 2005

(87) PCT Pub. No.: WO2005/067761

PCT Pub. Date: Jul. 28, 2005

(65) Prior Publication Data

US 2006/0157078 A1 Jul. 20, 2006

(30) Foreign Application Priority Data

Jan. 15, 2004 (JP) ..... 2004-008099
Jan. 23, 2004 (JP) ..... 2004-015222

(51) Int. Cl.
*A45D 2/00* (2006.01)

(52) U.S. Cl. ..... 132/207; 132/222

(58) Field of Classification Search ..... 132/222, 132/223, 203, 270, 246, 247, 245, 207; D28/37
See application file for complete search history.

(56) References Cited

U.S. PATENT DOCUMENTS 2,720,207 A * 10/1955 Burtnett ..... 132/246
5,584,309 A 12/1996 De Beneditis et al.
5,799,669 A * 9/1998 Briggs ..... 132/208

(Continued)

FOREIGN PATENT DOCUMENTS

JP 2003-93133 4/2003

(Continued)

OTHER PUBLICATIONS

U.S. Appl. No. 10/562,977, filed Dec. 29, 2005, Tojo et al.

(Continued)

*Primary Examiner*—Cris L Rodriguez
*Assistant Examiner*—Rachel R Steitz
(74) *Attorney, Agent, or Firm*—Oblon, Spivak, McClelland, Maier & Neustadt, L.L.P.

(57) ABSTRACT

A hair holder includes a flat tube having a sheet which forms a first side and a sheet which forms a second side. A hair bundle can be inserted from an opening at one end of the tube toward an opening at an other end of the tube. The sheet which forms the first side of the tube is more extensible in the length direction of the tube than the sheet which forms the second side of the tube. The sheet which forms the second side of the tube has a Taber stiffness of 0.4 mNm or higher. The sheet which forms the first side has an extensibility of at least 15 times an extensibility of the sheet which forms the second side under a load of 5 N.

13 Claims, 8 Drawing Sheets

U.S. PATENT DOCUMENTS

| | | | | |
|---|---|---|---|---|
| 5,970,991 | A * | 10/1999 | Srivastava | 132/274 |
| 6,227,207 | B1 * | 5/2001 | Stachowski | 132/273 |
| 7,198,049 | B2 * | 4/2007 | Elmer et al. | 132/208 |
| 2002/0189630 | A1 * | 12/2002 | Gray | 132/233 |
| 2006/0032513 | A1 | 2/2006 | Tojo et al. | |

FOREIGN PATENT DOCUMENTS

| | | | |
|---|---|---|---|
| JP | 2003-319815 | 11/2003 | |
| WO | WO 03/007752 A1 * | 1/2003 | |

OTHER PUBLICATIONS

U.S. Appl. No. 12/066,279, filed Mar. 10, 2008, Tojo, et al.

* cited by examiner

HAIR HOLDER

TECHNICAL FIELD

The present invention relates to a hair holder that is used as an aid in rolling a hair bundle into a desired shape to curl the hair by permanent waving and the like and a method of treating hair.

BACKGROUND ART

Japanese Patent Laid Open JP-A-2003-319815 filed by Kao Corporation discloses a hair holder which is a flat tube formed of a sheet in such a design to allow a hair bundle to be inserted from an opening at one end thereof toward an opening at the other end thereof. The hair holder having a hair bundle inserted therethrough is rolled up. The hair bundle is rolled up together with the tube so that hair can be curled by a simple operation.

DISCLOSURE OF THE INVENTION

In order to obtain an orderly curl hair, it is important to apply a certain amount of tension to a hair bundle while it is rolled. When the above-described hair holder is rolled up, the outer side sheet of the tube is restricted by the deformation. It follows that compression force is imposed to the hair in the tube and, as a result, the the curl becomes loose and, in the worst case, the hair is creased.

An object of the present invention is to provide a hair holder and a method of treating hair using the hair holder whereby a tension is given to hair in a tube and an orderly curl is given to the hair.

The present invention accomplishes the above object by providing a hair holder which is a flat tube having a first side and a second side and being formed of a sheet in such a design to allow a hair bundle to be inserted from an opening at one end thereof toward an opening at the other end thereof. The sheet which forms the first side of the tube is more extensible in the tube's length direction than the sheet which forms the second side of the tube. The sheet which forms the second side of the tube has a Taber stiffness of 0.4 mNm or higher.

The present invention also provides a method of treating hair using the hair holder of the present invention. In the method, a hair bundle is inserted through the tube, and the tube having the hair therein is rolled up with the first side thereof out.

BRIEF DESCRIPTION OF THE DRAWINGS

FIG. 1(*b*) is a rear perspective view of the embodiment of the hair holder according to the present invention.

FIG. 2(*b*) is a perspective showing a procedure in rolling a hair bundle in an embodiment of use of the hair holder shown in FIGS. 1(*a*) and 1(*b*).

FIG. 2(*c*) is a perspective showing a procedure in rolling a hair bundle in an embodiment of use of hair holder shown in FIGS. 1(*a*) and 1(*b*).

FIG. 2(*d*) is a perspective showing a procedure in rolling a hair bundle in an embodiment of use of the hair holder shown in FIGS. 1(*a*) and 1(*b*).

FIG. 6(*b*) is a frontal perspective view of the still another embodiment of the hair holder according to the present invention in its rolled up state.

FIG. 6(*c*) is a frontal perspective view of the still another embodiment of the hair holder according to the present invention in its rolled up state.

FIG. 7(*b*) is a central vertical cross-sectional view of the hair holder shown in FIG. 7(*a*).

DETAILED DESCRIPTION OF THE INVENTION

The hair holder of the present invention will be described based on its preferred embodiment with reference to FIGS. 1(*a*) and 1(*b*).

Figure 1A:
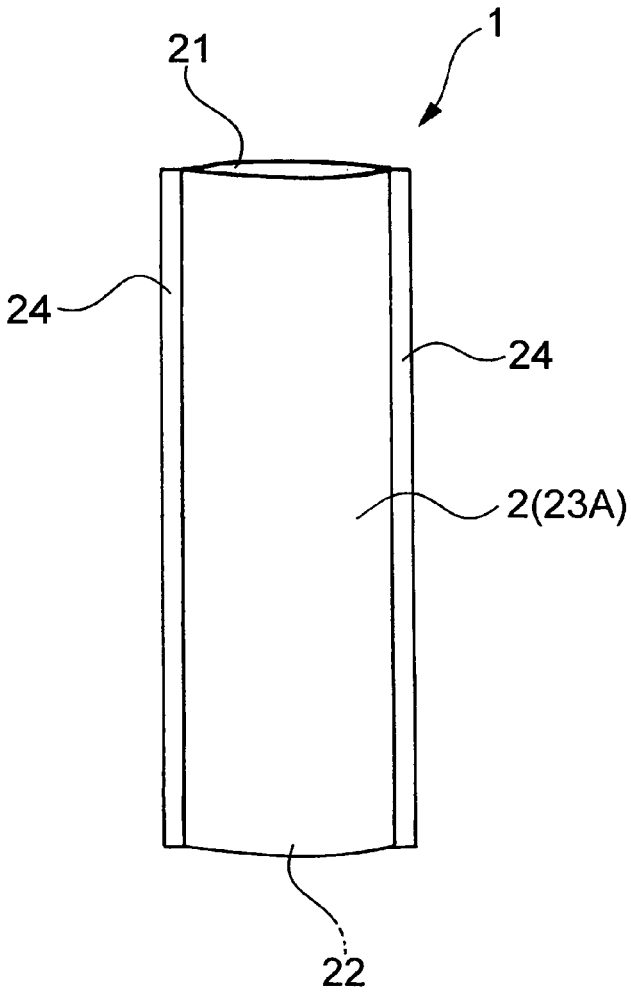
FIG. 1(*a*) is a frontal perspective view of an embodiment of the hair holder according to the present invention.
Figure 1B:
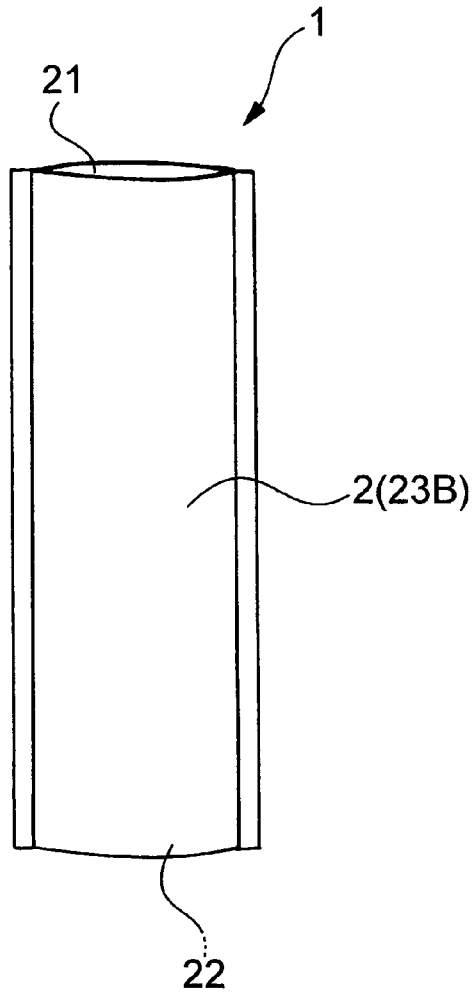
Figure 2A:
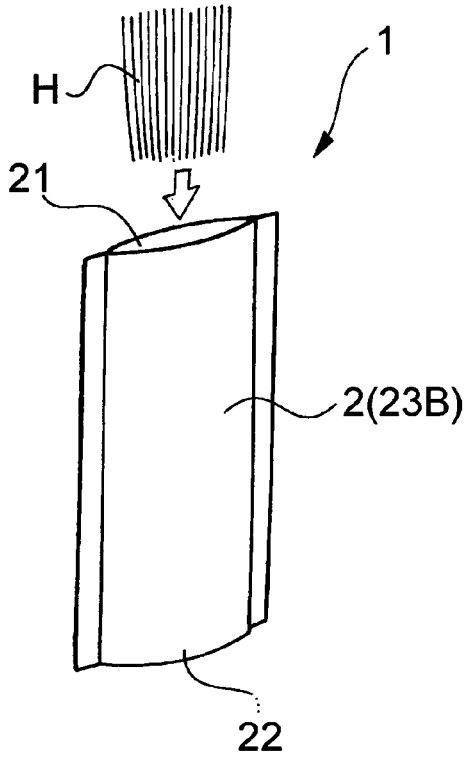
FIG. 2(*a*) is a perspective showing a procedure in rolling a hair bundle in an embodiment of use of the hair holder shown in FIGS. 1(*a*) and 1(*b*).
Figure 2B:
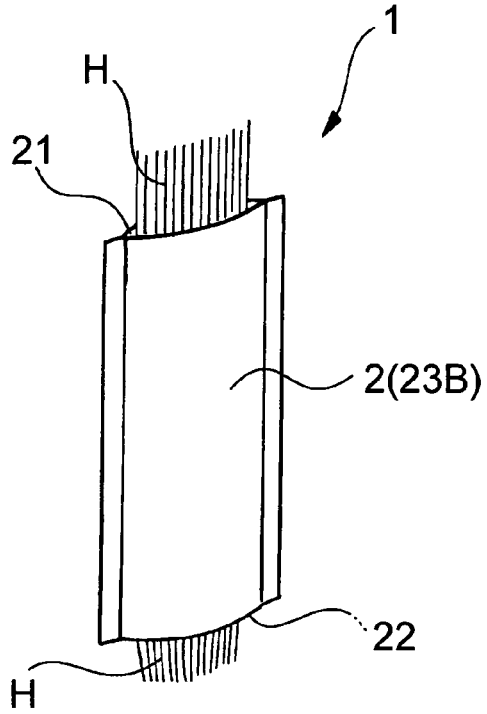
Figure 2C:
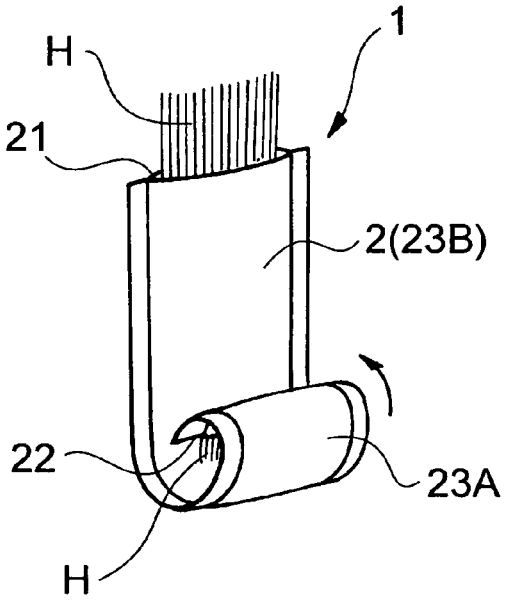
Figure 2D:
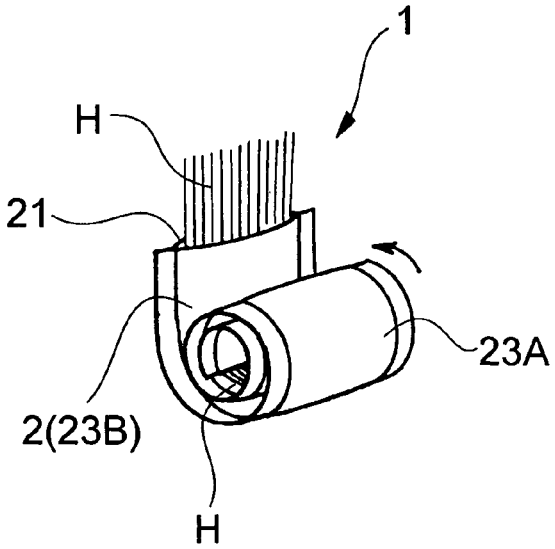

As shown in FIGS. 1(*a*) and 1(*b*), the hair holder 1 of the present embodiment is a flat tube 2 formed of a sheet. The tube 2 is designed to allow a hair bundle H (see FIGS. 2(*a*) to 2(*d*)) to be inserted from its opening 21 at one end thereof to another opening 22 at the other end thereof. One side of the tube 2 (hereinafter "the first side") is formed of a sheet 23A, and another side (hereinafter "the second side") is formed of a sheet 23B. The sheet 23A is more extensible in the tube's length direction than the sheet 23B. The sheet 23B has a Taber stiffness of 0.4 mNm or higher.

The hair holder 1 of the present embodiment will be described in detail.

As illustrated in FIGS. 1(*a*) and 1(*b*), the tube 2 is made up of two rectangular sheets 23A and 23B joined together along their long sides 24 and 24. A preferable size of the tube 2 measures 50 to 350 mm in length, 20 to 100 mm in major diameter, and 0 to 30 mm in minor diameter. These dimensions can be decided appropriately according to the length of the hair, what part of the hair is to be curled, and the thickness of the hair bundle to be inserted.

The sheet 23A that defines the first side (hereinafter "the first side sheet 23A") is made of an extensible material and is therefore extensible. Extensible sheet materials include nonwoven fabrics (e.g., polyethylene nonwoven fabric and polyethylene terephthalate nonwoven fabric), and woven fabrics.

The first side sheet 23A has an extension of 5% or more, preferably 10% or more, under a load of 5 N. If the extension is less than 5%, the stress generated in rolling up the hair holder having hair inserted therein cannot be relaxed sufficiently, which can result in a non-uniform rolled shape and, in the worst case, a failure to roll up.

The "extension under a load of 5 N" as referred to in the present invention is an elongation (or tensile stress) measured by "Determination of Tensile Properties of Films and Sheets" specified in JIS K7127, which is a percentage of an extension caused by pulling a sheet in the length direction of the tube with a 5 N load to the original length. The speed of pulling in the tensile test is 20 mm/min, and the span length is 100 mm.

The sheet which forms the second side (hereinafter "the second side sheet 23B") has substantially no extensibility in the length direction. More specifically, the extension under a 5 N load is 5% or less.

The second side sheet 23B has a Taber stiffness of 0.4 mNm or higher, preferably 1 mNm or higher. The Taber stiffness as referred to in the present invention is one measured by the Taber stiffness tester method specified in JIS P8125.

If the Taber stiffness of the second side sheet is out of the recited range, when the hair holder having a hair bundle inserted therethrough is rolled up, the second side sheet undergoes buckling or deformation and fails to exert sufficient tension to the hair, which results in poor curl or a loose curl.

In the present embodiment, it is preferred for the first side sheet 23A to have at least 15 times, more preferably at least 30 times, as high an extension under a load of 5 N as the second side sheet.

Where the extension of the first side sheet is less than 15 times that of the second side sheet, the first side sheet tends to fail to absorb the stress generated on deformation sufficiently. It can follow that the second side sheet undergoes non-uniform deformation or buckling, resulting in a poor curl or a loose curl.

Various kinds of flexible materials are used as the first side sheet 23A and the second side sheet 23B that constitute the tube 2. Examples include nonwoven fabrics (such as polyethylene nonwoven fabric and polyethylene terephthalate nonwoven fabric), woven fabrics, porous or non-porous resin films (e.g., polyethylene film and polyethylene terephthalate film), paper, polymer sheets, rubber sheets, and composites of these materials.

In the present embodiment, an air-through nonwoven fabric made of PP/PP sheath/core conjugate fiber is used as the first side sheet 23A, and a polyethylene terephthalate (PET) nonwoven fabric permeable to a hair treating agent is used as the second side sheet 23B. The hair treating agent includes those for permanent waving.

The first side sheet 23A and the second side sheet 23B both preferably have a thickness of 30 to 500 μm.

An embodiment of the method of treating hair by use of the hair holder of the embodiment shown in FIGS. 1(*a*) and 1(*b*) will be described with reference to FIGS. 2(*a*) through 2(*d*).

In the hair treating method according to the present embodiment, the hair holder 1 shown in FIGS. 1(*a*) and 2(*b*) is used. A hair bundle H is inserted through the tube 2 of the hair holder 1, and the tube 2 with the hair therein is rolled up with the first side sheet 23A out.

The hair treating method of the present embodiment will be illustrated more specifically.

The hair holder 1 formed by the tube 2 is prepared. The length and the width of the tube 2 are chosen according to the volume of the hair bundle H and a desired shape of a curl. The one end opening 21 of the tube 2 is widened into an elliptic opening as shown in FIG. 2(*a*), and the hair bundle H is inserted from the opening 21. The hair bundle H is passed through the tube 2 until the tip of the stand slightly sticks out of the other end opening 22 of the tube 2 as shown in FIG. 2(*b*).

After the hair bundle H is passed through the tube 2, the tube 2 is rolled up from the other end opening 22 at a desired starting diameter with the first side sheet 23A out as depicted in FIGS. 2(*c*) and 2(*d*). The hair bundle H is kept in the rolled state by means of a well-known fixing member, such as a clip (not shown). Thereafter a hair treating agent for permanent waving is applied to the hair bundle H from the outside of the tube 2. The hair treating agent is supplied to the hair bundle H via the first side sheet 23A and the second side sheet 23B. After an elapse of a given time, the hair bundle H is released from the tube 2 and subjected to post-treatment such as shampooing to complete permanent waving.

If necessary, the opening 21 of the tube 2 is widened into a circular shape when a hair bundle H is inserted therethrough, which will be more helpful to insert the hair bundle H smoothly. The hair bundle H does not always need to be inserted until its tip sticks out of the other end opening 22 of the tube 2.

When the tube 2 having the hair bundle H inserted therethrough is rolled up with the first side sheet 23A out as described, a stretching stress is applied to the first side sheet 23A which has a larger turning diameter. Since the first side sheet 23A is more extensible in the length direction of the tube 2 than the second side sheet 23B, the first side sheet 23A stretches easily as a whole. As a result, a certain amount of tension is imposed on the hair bundle H inserted through the tube 2. Thus, the hair holder 1 according to the present embodiment gives hair an orderly curl easily and surely.

When the hair is curled particularly by permanent waving treatment, it is preferred to apply a proper amount of tension to the hair while being treated in order to prevent irregular deformation, contraction, and folding and to ensure tightness or the roll. In the present embodiment, the first side sheet 23A stretches easily, and the second side sheet 23B has a certain stiffness. That design causes the hair holder to induce the proper tension to be exerted to the hair upon being rolled up, which allows for easily and surely providing the hair with an orderly curl.

Other embodiments of the hair holder of the present invention will be described only with reference to differences from the embodiment shown in FIGS. 1(*a*) and 1(*b*). The description of the embodiment shown in FIGS. 1(*a*) and 1(*b*) applies appropriately to those particulars that are not referred to hereunder. Similarly to the hair holder of the embodiment shown in FIGS. 1(*a*) and 1(*b*), the hair holders of the other embodiments give hair an orderly curl easily and surely.

Figure 3:
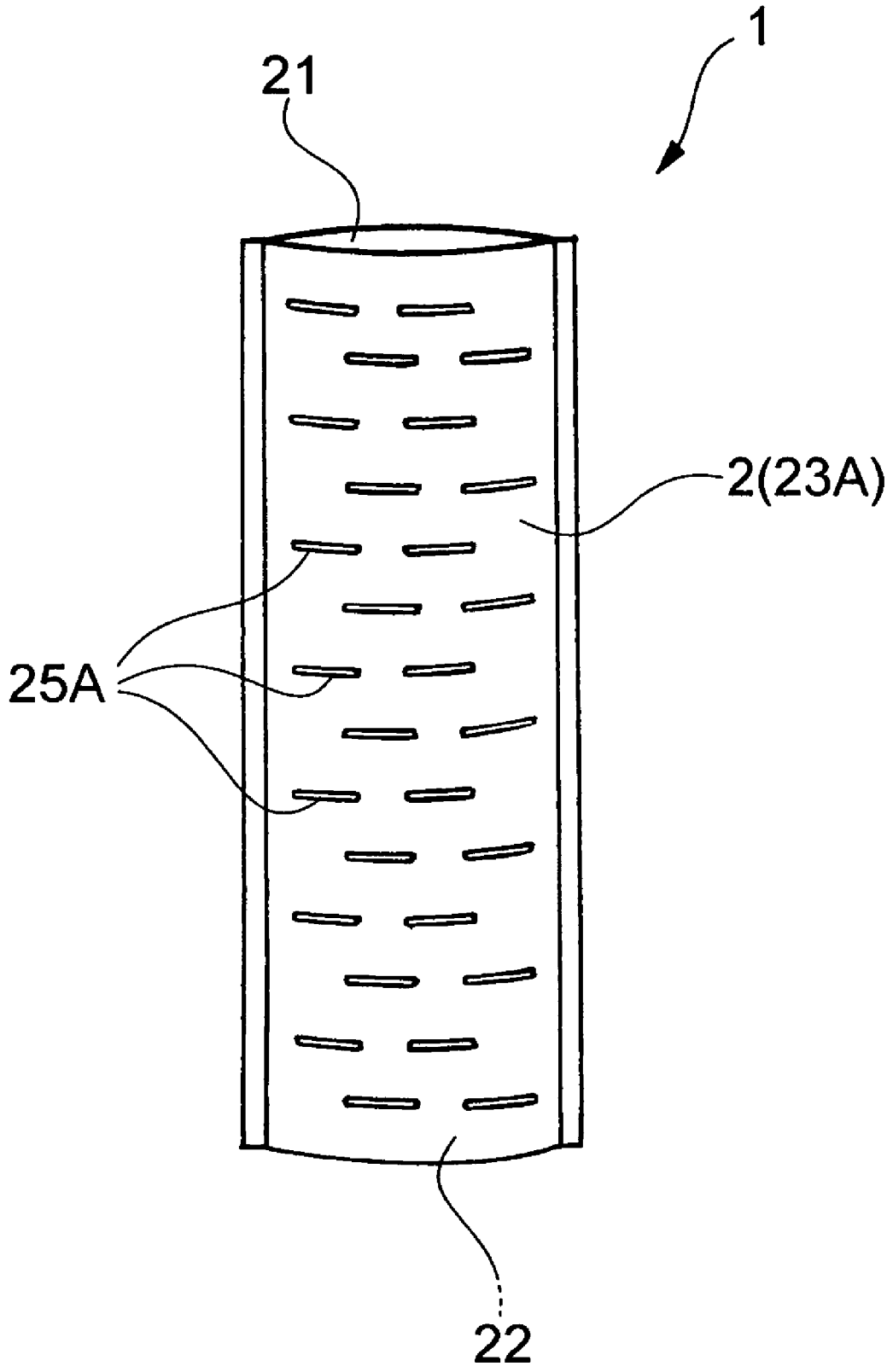
FIG. 3 is a frontal perspective view of another embodiment of the hair holder according to the present invention.

A hair holder 1 of the embodiment shown in FIG. 3 has a large number of sheet openings 25A formed in the first side sheet 23A. The sheet openings 25A each measure about ¼ the width of the first side sheet 23A. With the tube 2 being held vertically, the openings 25A are arranged such that two openings 25A are spaced out at the same height, and another two openings 25A vertically adjacent to the first-mentioned two openings 25A are spaced out with their positions in the width direction of the tube 2 shifted from those of the first-mentioned two openings 25A by about ¼ the width of the first side sheet 23A.

Such many openings 25A in the first side sheet 23A create an extensible structure so that the hair holder 1 of the embodiment shown in FIG. 3 produces the same effects as by the hair holder of the embodiment shown in FIGS. 1(*a*) and 1(*b*).

Figure 4:
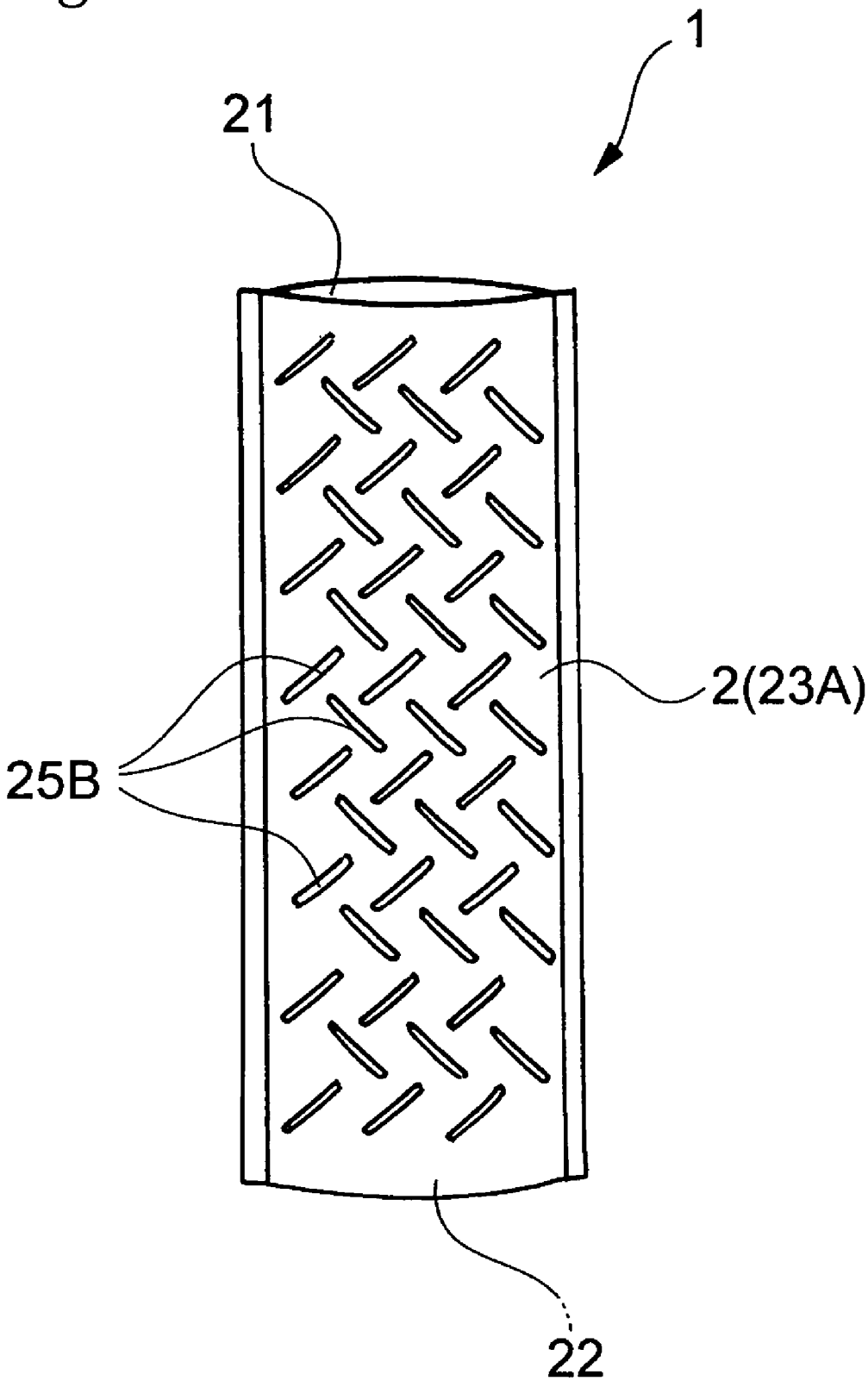
FIG. 4 is a frontal perspective view of still another embodiment of the hair holder according to the present invention.

A hair holder 1 of the embodiment shown in FIG. 4 has a large number of 45-degree oblique openings 25B in the first side sheet 23A of the tube 2. With the tube 2 held vertically, the openings 25B are arranged such that three openings 25B are spaced out at the same height and at the same oblique angle, and another three openings 25B vertically adjacent to the first-mentioned three openings 25B are also spaced out in the width direction with their positions in the width direction of the first side sheet 23A and their oblique angle differing from those of the first-mentioned three openings 25B by about ⅙ the width of the first side sheet 23A and by 180°, respectively.

Such many openings 25B in the first side sheet 23A create an extensible structure so that the hair holder 1 of the embodiment shown in FIG. 4 produces the same effects as by the hair holder of the embodiment shown in FIGS. 1(*a*) and 1(*b*).

Figure 5:
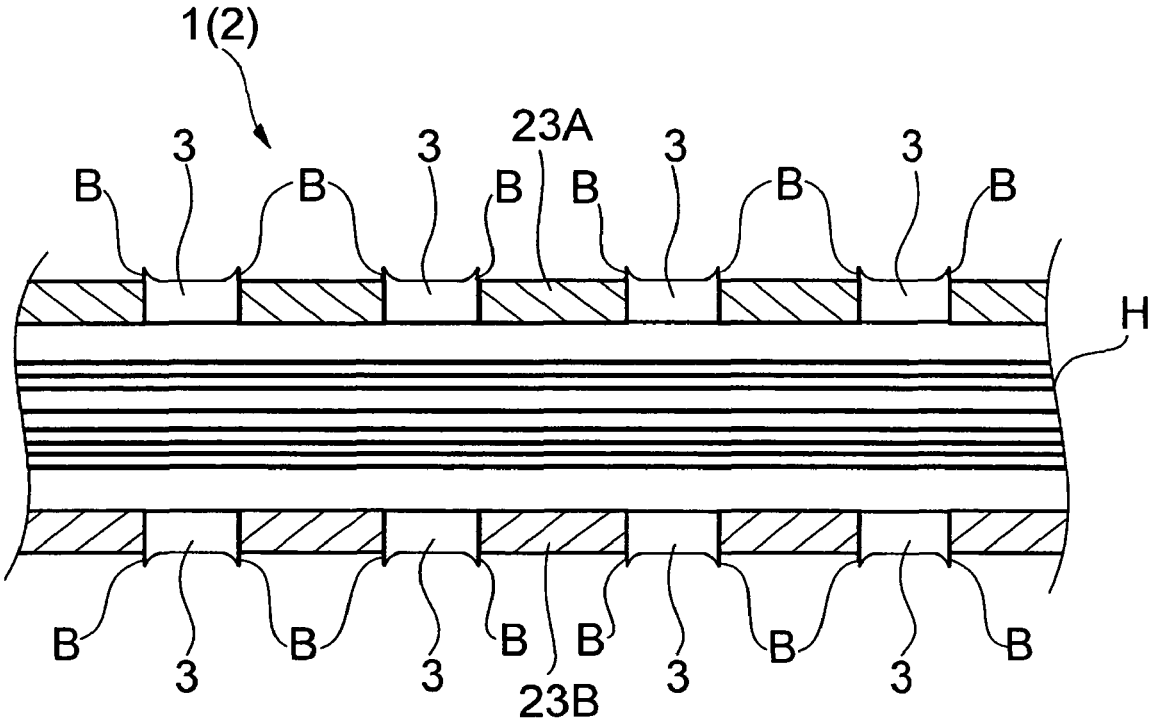
FIG. 5 is a schematic cross-sectional view of still another embodiment of the hair holder according to the present invention having a hair bundle inserted therethrough, with the burrs of the sheets forming tube exaggerated.

The hair holder according to the present invention may have a large number of through-holes in at least one of the first side sheet and the second side sheet which form the tube. A hair holder 1 of the embodiment shown in FIG. 5 has through-holes 3 in both the first side sheet 23A and the second side sheet 23B of the tube 2. The through-holes are usually formed by punching. Punching a sheet creates burrs projecting around the edge of the through-holes. Burrs are indicated by symbol B in FIG. 5. According to the embodiment shown in FIG. 5, because the sheets are joined to make the hair holder 1 with their burr-free, smooth side facing inside, the hair is prevented from being damaged by the burrs while the hair bundle H is being inserted through the tube 2.

When only a restricted part of a hair bundle is to be treated with a hair treating agent, a part of the tube may be made impermeable to a hair treating agent. Use of a so designed hair holder protects the part of the hair bundle which is in contact with the impermeable part of the tube from penetration of the treating agent.

Figure 6A:
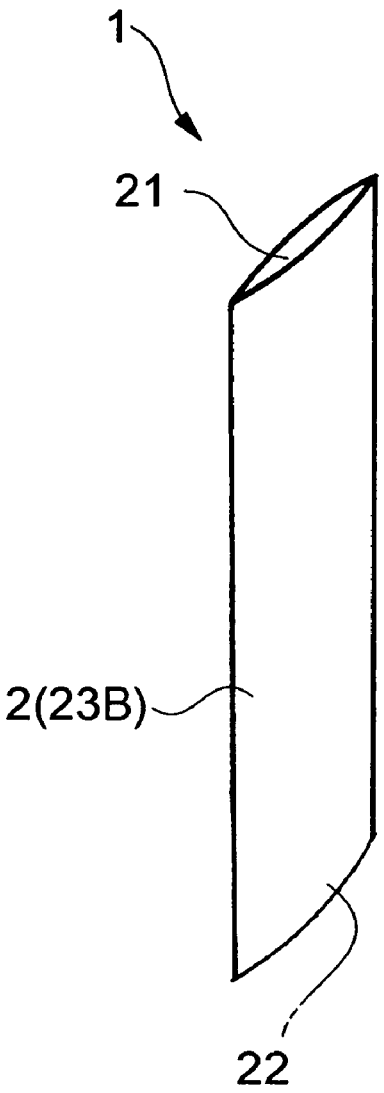
FIG. 6(*a*) is a frontal perspective view of still another embodiment of the hair holder according to the present invention in its stretched out state.
Figure 6B:
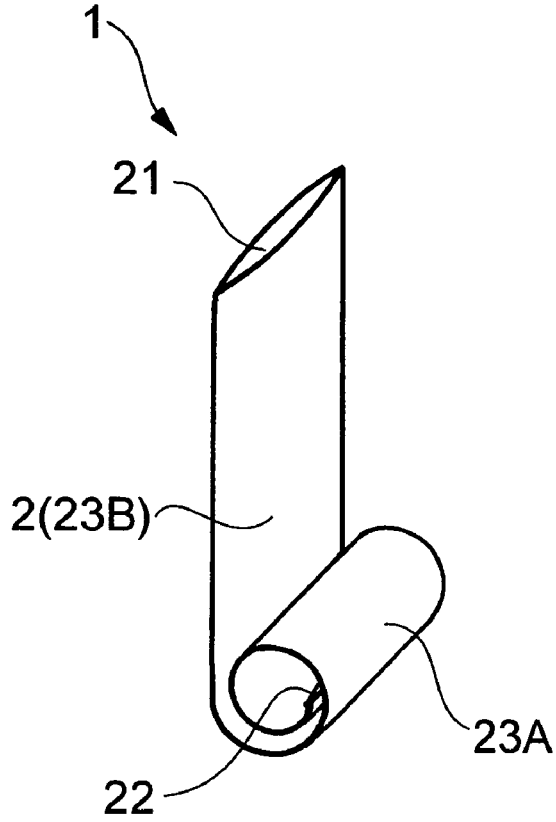
Figure 6C:
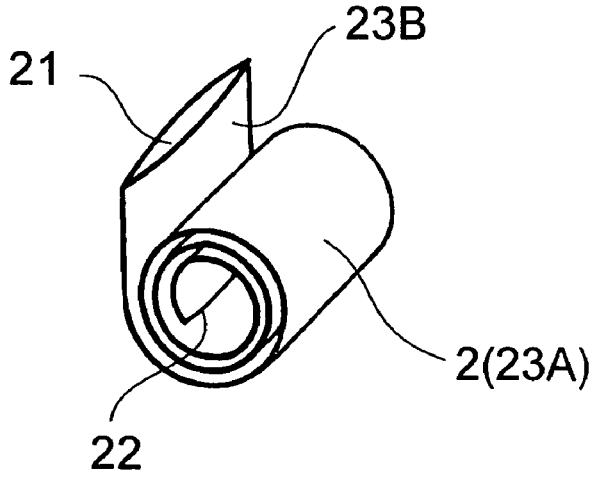

A hair holder 1 of the embodiment shown in FIGS. 6(*a*), 6(*b*), and 6(*c*) has its tube 2 designed to roll itself up into a prescribed shape and to keep the rolled up state. Specifically, the tube 2 has been processed by prescribed means so as to self-roll with the first side sheet 23A out and keep the rolled up state (hereinafter referred to as a self-rolling tube).

Therefore, when the tube 2 is in the unrolled stretched out state (see FIG. 6(*a*)) and the state is released, it returns to its original rolled shape spontaneously as illustrated in FIGS. 6(*b*) and 6(*c*).

In order to make the self-rolling tube 2, it is convenient to use an elastically deformable material cut to a desirable shape and size as a sheet material. The elastically deformable material includes polyethylene terephthalate, polypropylene, polystyrene, and polyacrylonitrile. A self-rolling tube can be obtained by making a tube of such an elastically deformable material, rolling up the tube, fixing the tube in the rolled up state by an ordinary means, and heating the rolled up tube to an appropriate temperature to make the tube memorize the rolled shape.

According to the embodiment shown in FIGS. 6(*a*) through 6(*c*), after a hair bundle is inserted in the tube 2 in the unrolled stretched out state, the tube is let free, whereby it self-rolls up spontaneously with its first side sheet 23A out. Therefore, the hair holder 1 of this embodiment needs no rolling operation. There is another advantage that means for maintaining the rolled state, such as a clip, is unnecessary.

While, in the embodiments shown in FIGS. 3 and 4, the first side sheet 23A is made structurally extensible by forming openings therein, other structures may be adopted to make the first side sheet extensible. Among such structures is the one shown in FIGS. 7(*a*) and 7(*b*), in which a plurality of rectangular pieces are connected with an overlap with one another to form the first side sheet.

Figure 7A:
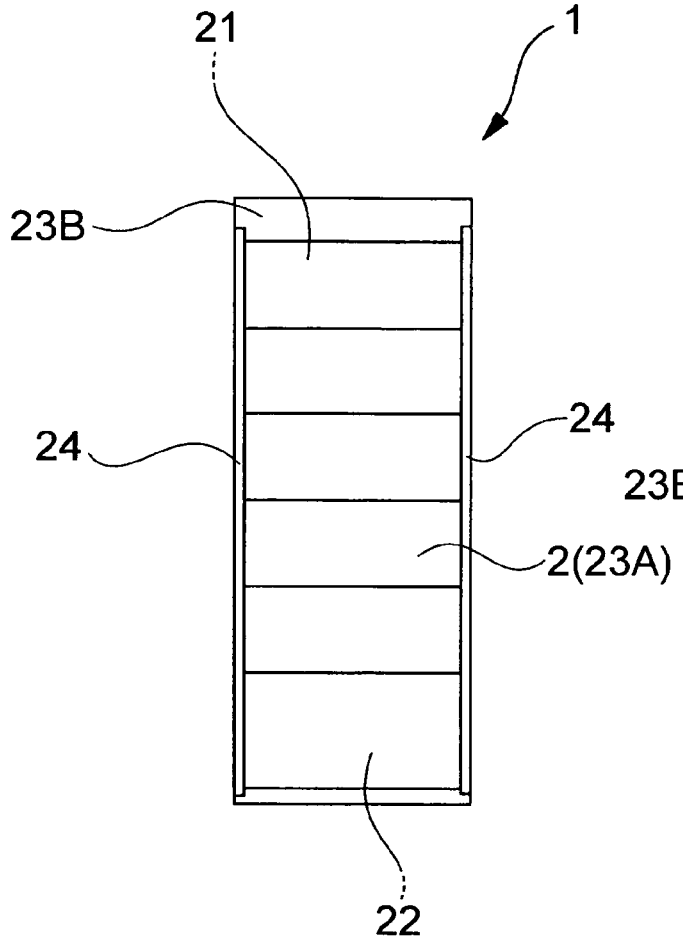
FIG. 7(*a*) is a schematic front view of yet another embodiment of the hair holder according to the present invention.
Figure 7B:
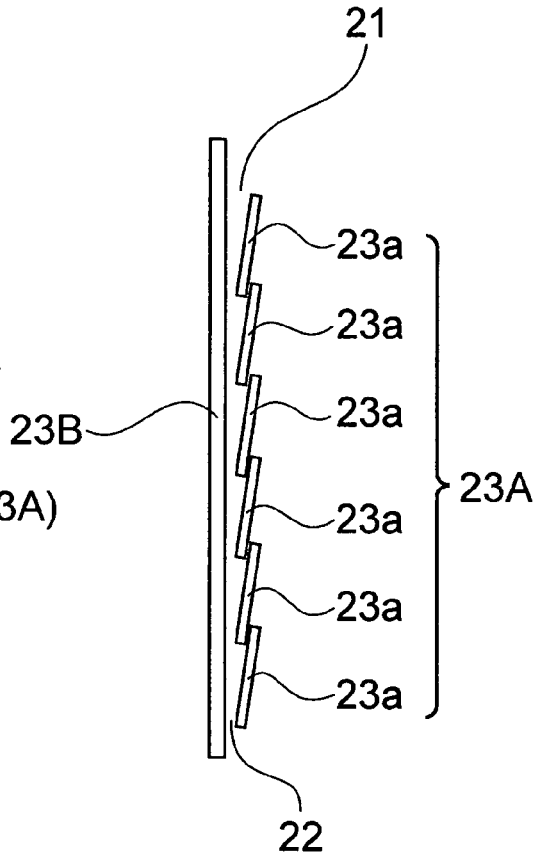

In the hair holder shown in FIGS. 7(*a*) and 7(*b*), the first side sheet 23A is composed of a plurality of (six in the present embodiment) rectangular pieces 23*a*. The rectangular pieces 23*a* are aligned in the length direction of the tube 2, being connected with an overlap between every adjacent rectangular pieces 23*a*. The both side edges 24 of every rectangular piece 23*a* thus aligned are sealed with the both side edges of the second side sheet 23B and the tube 2 is formed. Each of the rectangular pieces 23*a* is not bonded to either the adjacent rectangular pieces 23*a* and the second side sheet 23B, except at both side edges 24.

According to the present embodiment, since the first side sheet 23A of the hair holder is composed of a plurality of rectangular pieces 23*a* in the above-described configuration, the rectangular pieces 23*a* slide at their overlaps when the tube 2 is rolled up with the first side sheet 23A out so that the first side sheet 23A stretches as a whole.

In order for the self-rolling hair holder to maintain its rolling up ability even when used repeatedly, it is an effective method to provide the tube with a reinforcing strip made of a material having a glass transition temperature at or higher than room temperature in the length direction of the tube. It is also effective that at least one of the first side sheet and the second side sheet of the tube be made of a material having a glass transition temperature at or above room temperature.

In that case, it is more preferred that the material whose glass transition temperature is at or higher than room temperature which makes up the first side sheet, the second side sheet or the reinforcing strip contain an amorphous portion in a proportion of at least 50% by volume, more preferably 70% by volume or more, to help the hair holder memorize the rolled shape.

In order to facilitate inserting a hair inserter having a hair bundle caught thereon through the self-rolling hair holder, it is recommended that a sheet having an extension of 5% or more under a load of 5 N is used to as the first side sheet of the tube, that at least one of the long side portions of the first side sheet is provided with a stiffer portion having higher stiffness than the widthwise middle portion of that sheet and extending in the length direction of that sheet, and that the second side sheet has a Taber stiffness of 0.4 mNm or higher.

The stiffer portion of the first side sheet preferably has a Taber stiffness of 0.4 mNm or higher.

It should be understood that the hair holder of the present invention is not limited to the aforementioned embodiments, and various alterations can be made therein as follows without departing from the spirit and scope thereof.

The tube may be designed to have one end thereof kept open with the other end provided with opening and closing means. The method of fabricating the tube is not restricted. For instance, the tube is fabricated by joining edges of a sheet or sheets by sewing or fusion bonding or with an adhesive, or the tube may be an integrally molded article obtained by extrusion or like techniques.

Different elements of the foregoing embodiments may be altered or combined appropriately to develop different embodiments.

The shape and the surface condition of the sheet or sheets constructing the tube of the hair holder according to the present invention are not limited as long as the sheet(s) can be shaped into a tubular form having the above-described structure. The sheet(s) making a "flat" shape may have an uneven surface.

The method of making the sheet openings in the tube is not particularly limited. For example, a sheet material is cut or punched to make the openings. The shapes of the sheet openings are not limited to the slits as used in the described embodiments and include rectangles, ellipses, and lines.

The manner of using the hair holder according to the present invention is not limited to the usage illustrated in FIGS. 2*a* to 2*d* (an embodiment of the method of treating hair according to the present invention). The hair holder may be used in combination with a curling rod which has conventionally been used in rolling up a hair bundle. The hair holder of the present invention can be applied to hair curling not only by permanent waving but by applying heat with a dryer, etc. to rolled hair, maintaining a dry hair bundle in a rolled-up state, or maintaining a wet hair bundle in a rolled-up state to let the hair dry spontaneously. The hair holder can also be applied to not only curling the tip of hair but curling hair in a zig-zag or spiral form.

Hair may be curled in the above-described method after applying a commercially available hair grooming product thereto.

EXAMPLES

Figure 8:
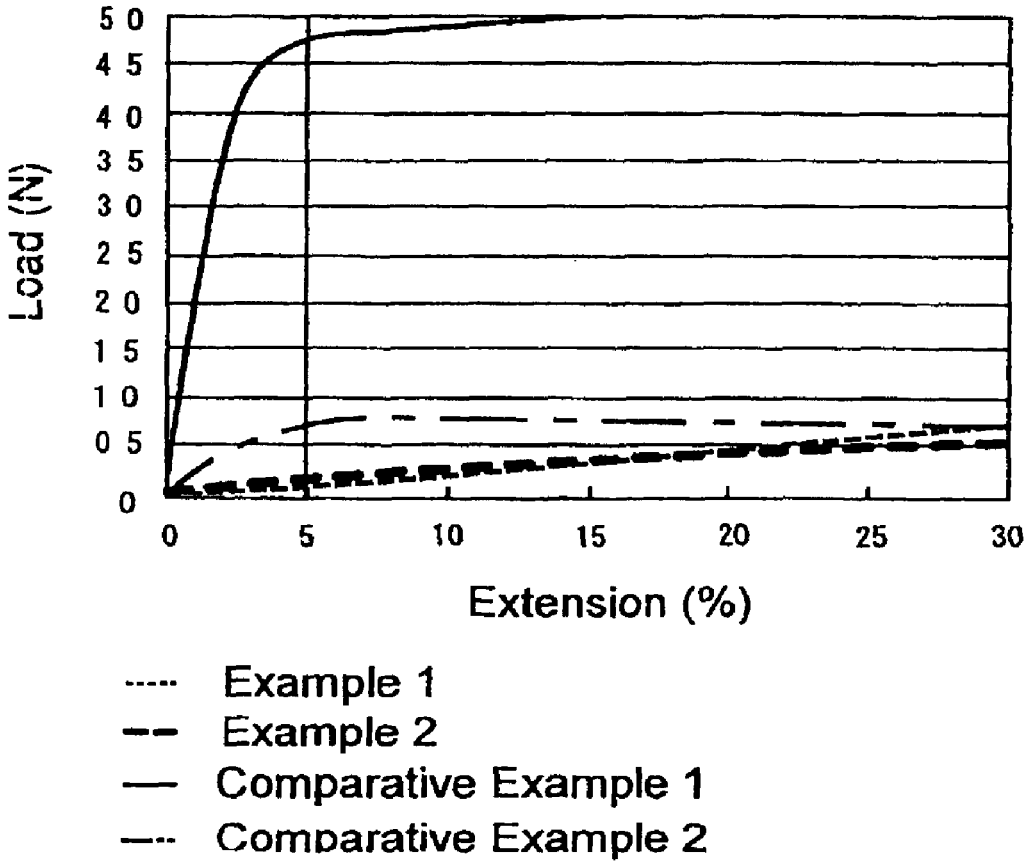
FIG. 8 is a graph of the extension characteristics of the fabrics used in the hair holder.

The results of testing to evaluate a curl are shown below. FIG. 8 is a graph of the extension characteristics of the fabrics used in the hair holder for Examples 1 and 2 and Comparative Examples 1 and 2, below.

Example 1

An air-through nonwoven fabric (LT400; weigh per unit area: 40 g/m$^2$) made of PP/PP core-in-sheath conjugate fiber, the extension characteristics of which are represented by the fine dotted line in the graph shown in FIG. 8, was used as a first side sheet of a tube of a hair holder. A polyester nonwoven fabric (Smash Y15150, available from Asahi Chemical Industry Co., Ltd.; weight per unit area: 150 g/m$^2$) was used as a second side sheet. The two sheets were joined along their long side edges to make a tube (hair holder) having a length of 250 mm, a major diameter of 70 mm, and a minor diameter of 0.5 mm.

A hair bundle weighing about 10 g was rolled up using the above-mentioned hair holder and was treated with commercially available thioglycolic acid-based permanent waving solutions (1:1; hard type). The result was evaluated with the visual evaluation and the curl finish ranks are the following.

A: Uniform and orderly curl

B: Nearly uniform curl or loose curl

C: Non-uniform and unattractive curl

Example 2

A hair holder of the same size as obtained in Example 1 was prepared using a PET nonwoven fabric (weight per unit area: 100 g/m$^2$; thickness: 1 mm; manufactured by Vilene) the extension characteristics of which are represented by the thick dotted line in the graph shown in FIG. 8 as a first side sheet and the same second side sheet as used in Example 1. A curl formed by the resulting hair holder was evaluated in the same manner as in Example 1.

Comparative Example 1

A hair holder of the same size as obtained in Example 1 was prepared using a pair of sheets the extension characteristics of which are represented by the solid line in the graph of FIG. 8, which sheets are the same as the second side sheet used in Example 1. A curl formed by the resulting hair holder was evaluated in the same manner described in Example 1.

Comparative Example 2

A hair holder of the same size obtained in Example 1 was prepared using an LDPE (low-density polyethylene) film (thickness: 30 μm) the extension characteristics of which are represented by the dot-dash line in the graph shown in FIG. 8 as a first side sheet and a polyester nonwoven fabric (Smash Y15150, available from Asahi Chemical Industry Co., Ltd.; weight per unit area: 50 g/m$^2$) as a second side sheet. A curl formed by the resulting hair holder was evaluated in the same manner described in Example 1.

TABLE 1

| | Extension under 5 N Load (%) | | Taber Stiffness of | |
|---|---|---|---|---|
| | First Side Sheet | Second Side Sheet | Second Side Sheet (mNm) | Curl Finish |
| Example 1 | 29 | 0.2 | 2.0 | A |
| Example 2 | 23.1 | 0.2 | 2.0 | A |
| Comparative Example 1 | 0.2 | 0.2 | 2.0 | C |
| Comparative Example 2 | 2.5 | 0.4 | 0.22 | C |

As is apparent from the results of evaluation shown in Table 1, an orderly curl finish is achieved by using hair holders in which the first side sheet has a higher extension than the second side sheet, and the second side sheet has a Taber stiffness of at least a specific value.

INDUSTRIAL APPLICABILITY

The hair holder and the method of treating hair according to the present invention provide the proper amount of tension on hair to create an orderly curl finish.

The invention claimed is:

1. A hair holder, comprising:

a flat tube having a sheet which forms a first side and a sheet which forms a second side to allow a hair bundle to be inserted from an opening at one end of the tube toward an opening at an other end thereof such that, when the hair holder is rolled up, the sheet which forms the first side is on an outside of the tube, the sheet which forms the first side of the tube is more extensible in a length direction of the tube than the sheet which forms the second side of the tube, the sheet which forms the second side of the tube has a Taber stiffness of 0.4 mNm or higher, the sheet which forms the first side has an extensibility of at least 15 times an extensibility of the sheet which forms the second side under a load of 5 N, the extensibility of the sheet which forms the first side is 10% or higher under the load of 5 N, and the extensibility of the sheet which forms the second side is 5% or less under the load of 5 N.

2. The hair holder according to claim 1, wherein the sheet which forms the first side has a large number of openings making the sheet extensible.

3. The hair holder according to claim 1, wherein the sheet is permeable to a hair treating agent.

4. The hair holder according to claim 1, wherein at least one of the sheet which forms the first side and the sheet which forms the second side has a large number of through-holes each having a smooth edge on one side thereof, and the sheet which forms the first side and the sheet which forms the second side are joined together with a side having a smooth edge facing inside the tube.

5. The hair holder according to claim 1, wherein the tube is configured to roll itself up into a prescribed shape and to keep the rolled up state.

6. The hair holder according to claim 1, wherein the sheet which forms the first side has a plurality of rows, each of the rows including two horizontal openings, the horizontal openings in alternate rows overlap one another in a vertical direction, and the plurality of rows of the horizontal openings are configured to make the sheet extensible.

7. The hair holder according to claim 1, wherein the sheet which forms the first side has a plurality of rows, each of the rows including three oblique openings, the oblique openings in alternate rows overlap one another in a vertical direction, and the plurality of rows of the oblique openings are configured to make the sheet extensible.

8. The hair holder according to claim 1, wherein the sheet which forms the first side includes a plurality of rectangular pieces, and each rectangular piece is configured to partially overlap an adjacent rectangular piece in a horizontal direction, and the plurality of overlapping rectangular pieces are configured to make the sheet extensible.

9. The hair holder according to claim 8, wherein each of the plurality of rectangular pieces is only bonded to the adjacent rectangular piece at side edges thereof.

10. The hair holder according to claim 1, wherein the sheet which forms the first side has the extensibility of at least 30 times the extensibility of the sheet which forms the second side under the load of 5 N.

11. A method of treating hair, comprising:

employing a hair holder including a flat tube having a sheet which forms a first side and a sheet which forms a second side, the sheet which forms the first side of the tube is more extensible in the length direction of the tube than the sheet which forms the second side of the tube, the sheet which forms the second side of the tube has a Taber stiffness of 0.4 mNm or higher, the sheet which forms the first side has an extensibility of at least 15 times an extensibility of the sheet which forms the second side under a load of 5 N, the extensibility of the sheet which forms the first side is 10% or higher under the load of 5 N, and the extensibility of the sheet which forms the second side is 5% or less under the load of 5 N;

inserting a hair bundle through an opening at one end of the tube of the hair holder toward an opening at an other end thereof; and rolling up the tube having the hair therein with the first side thereof facing out.

12. The method according to claim 11, wherein the sheet which forms the first side has the extensibility of at least 30 times the extensibility of the sheet which forms the second side under the load of 5 N.

13. The method according to claim 11, further comprising:

providing a reinforcing strip in the hair holder having a glass transition temperature at or above a room temperature.

* * * * *